United States Patent [19]

Iida

[11] Patent Number: 4,956,981

[45] Date of Patent: Sep. 18, 1990

[54] CIRCULAR KNITTING MACHINE WITH MULTIPLE NUMBER OF FEEDS

[75] Inventor: Yukiari Iida, Hyogo, Japan

[73] Assignee: Precision Fukuhara Works, Ltd., Hyogo, Japan

[21] Appl. No.: 336,094

[22] Filed: Apr. 11, 1989

Related U.S. Application Data

[63] Continuation-in-part of Ser. No. 180,055, Apr. 11, 1988, abandoned.

[51] Int. Cl.[5] ..... D04B 9/38

[52] U.S. Cl. ..... 66/20; 66/19

[58] Field of Search ..... 66/19, 20, 25, 38, 223, 66/222

[56] References Cited

U.S. PATENT DOCUMENTS

| | | | |
|---|---|---|---|
| 3,405,542 | 10/1968 | Berkenstein | 66/38 |
| 3,456,460 | 7/1969 | Mishcon | 66/20 |
| 3,614,877 | 10/1971 | Radin | 66/42 R |
| 3,670,526 | 6/1972 | Martinetz | 66/20 |
| 3,763,667 | 10/1973 | Mishcon | 66/223 |
| 3,780,539 | 12/1973 | Mishcon | 66/42 R |
| 3,795,119 | 3/1974 | Bourgeois | 66/20 |
| 3,967,468 | 7/1976 | Christopoulos | 66/38 |
| 4,036,033 | 7/1977 | Jesson | 66/225 |
| 4,080,805 | 3/1978 | Ricart | 66/19 |

FOREIGN PATENT DOCUMENTS

| | | | |
|---|---|---|---|
| 1132678 | 7/1962 | Fed. Rep. of Germany | 66/38 |
| 2534432 | 4/1976 | Fed. Rep. of Germany | 66/20 |

OTHER PUBLICATIONS

Darlington, Knitting Times, Sep. 3, 1973, vol. 42, No. 37, pp. 36–40.

Knitting Times, vol. 42, No. 7, 2/1973, Philip Develops 96–Feed Jacquard Unit.

*Primary Examiner*—Werner H. Schroeder

*Attorney, Agent, or Firm*—Bell, Seltzer, Park & Gibson

[57] ABSTRACT

Each feed of the multiple feed circular knitting machine is provided with selector cams to position needles in one of four positions, knit, tuck, welt and early withdrawal positions. Two types of knitting needles are provided and each type of needle includes a master butt with a knite selector butt and a tuck selector butt. The selector cams are mounted on rotatable selector cam cylinders which are positioned to overlap each other to permit the selector cams to be arranged at the closest possible lateral distance from each other and to thereby permit an increased number of feeds to be positioned around the machine. The early withdrawal position of the selector cams is provided so that the dial needles do not interfere with the formation of stitch loops by the cylinder needles, when knitting on only the cylinder needles, such as when forming blister knit stitch constructions.

2 Claims, 2 Drawing Sheets

CIRCULAR KNITTING MACHINE WITH MULTIPLE NUMBER OF FEEDS

REFERENCE TO RELATED APPLICATION

This application is a continuation-in-part of copending application Ser. No. 07/180,055, filed Apr. 11, 1988, now abandoned.

FIELD OF THE INVENTION

This invention relates generally to a multiple feed circular knitting machine of the type including selector cams mounted on rotary cylinders positioned in advance of each of the feeds for selectively positioning needles in one of four positions, knit, tuck, welt and early withdrawal positions, and more particularly to such a machine in which the selector cams are positioned at the closest possible lateral distance from each other to permit an increased number of feeds to be positioned around the machine.

BACKGROUND OF THE INVENTION

It is known to provide a multiple feed circular knitting machine which permits selection of the needles in one of three positions, knit, tuck and welt positions, at each of the feeds. Additionally, the selector device operates to move dial needles outwardly when knitting stitch loops on selected groups of cylinder needles to prevent movement of the stitch loops upwardly on the cylinder needles when forming blister knit types of stitch construction. In this conventional type of circular knitting machine, it is possible to provide, for example, 48 feeds in a machine having a 30 inch diameter needle cylinder. This known type of selector device is illustrated in FIG. 6 with the dial needles 4' including a master butt 4a' and having selector butts, as indicated at 4b', positioned at four different levels below the master butt 4a'. A first row of tuck selector cams is supported on rotatable tuck selector cam cylinders 9' while a second row of knit selector cams is supported in laterally spaced relationship on knit selector cam cylinders 11'.

In order to increase productivity of this type of machine, it is desirable to increase the number of feeds surrounding the needle cylinder and, therefore, the distance between individual feeds of the machine must be shortened. The arrangement of the adjacent rows of tuck and knit selector cams, illustrated in the prior art of FIG. 6, makes it practically impossible to narrow the distance L between the centers of the needle controlling cam cylinders 9', 11' so that it is not possible to substantially reduce the distance between the individual feeds of the knitting machine.

SUMMARY OF THE INVENTION

With the foregoing in mind, it is an object of the present invention to provide a multiple feed circular knitting machine with tuck and knit selector cams arranged at the closest possible lateral distance from each other so that it is possible to provide an increased number of feeds around the machine.

In accordance with the present invention, only two types of knitting needles are required and each type of knitting needle has a master butt adapted to be engaged by stitch cams to draw all of the needles to a stitch forming level immediately following each of the feeds. Each type of knitting needle also includes a single knit selector butt, and a single tuck selector butt. Two tuck selector cams are positioned in advance of the position where the needles are drawn to stitch forming level and the tuck selector cams are aligned to engage the tuck selector butts of each type of needle. Two knit selector cams are aligned to engage the knit selector butts and both the tuck and knit selector cams are mounted on rotatable cylinders to selectively position the tuck and knit selector cams in operative and inoperative positions. The knit selector cam cylinders are positioned to overlap portions of the tuck selector cam cylinders to permit the tuck and knit selector cams to be arranged at the closest possible lateral distance from each other and to thereby permit an increased number of feeds to be positioned around the machine. The knit selector cams may be selectively positioned in a knit position, a tuck position, a welt position, and a fourth position where they operate to move the dial needles outwardly between the cylinder needles to prevent upward movement of the stitch loops, particularly when forming blister type stitch constructions. In this fourth position, the dial needles are also withdrawn at an earlier than normal position so that the dial needles do not interfere with the formation of stitch loops by the cylinder needles. Because the pairs of tuck selector cams and knit selector cams are positioned at the closest possible lateral distance from each other, it is possible to provide a large number of feeds around the knitting machine, on the order of 72 feeds in a knitting machine having a 30 inch diameter needle cylinder.

BRIEF DESCRIPTION OF THE DRAWINGS

Other objects and advantages will appear as the description proceeds when taken in connection with the accompanying drawings, in which—

DESCRIPTION OF THE PREFERRED EMBODIMENT

Figure 1:
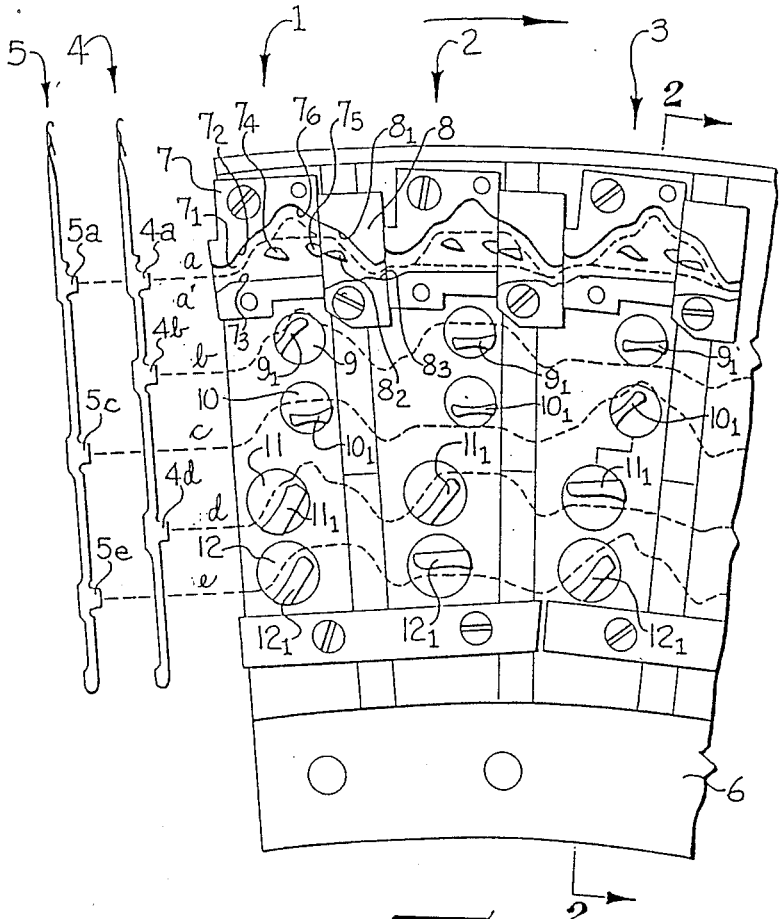
FIG. 1 is a somewhat schematic developed layout view of the dial cams at each of three adjacent feeds and illustrating the two types of dial needles utilized therewith.

As illustrated in FIG. 1, three adjacent feeds, broadly indicated at 1 through 3, of the dial of a circular knitting machine are illustrated with the tuck and knit cam selector devices of the present invention associated with each of the feeds 1–3. Two different types of dial needles, broadly indicated at 4, 5, are supported for radial sliding movement in the dial of the knitting machine. These dial needles 4, 5 cooperate with cylinder needles, indicated at 4a, 5a in FIG. 5, in a conventional manner to form the knit fabric. A dial cam holder 6 supports an outer guard cam 7 and a stitch cam 8 (FIG. 1). The dial cam holder 6 also rotatably supports two knit selector cam cylinders, broadly indicated at 9, 10 in FIG. 2, and two tuck selector cam cylinders 11, 12. The inner end portions of the cylinders 9, 10 are provided with respective knit selector cams $9_1$, $10_1$ which are aligned with and adapted to engage the respective upper selector butts **4*b* and 5*c* of the respective dial needles 4, 5**.

Figure 2:
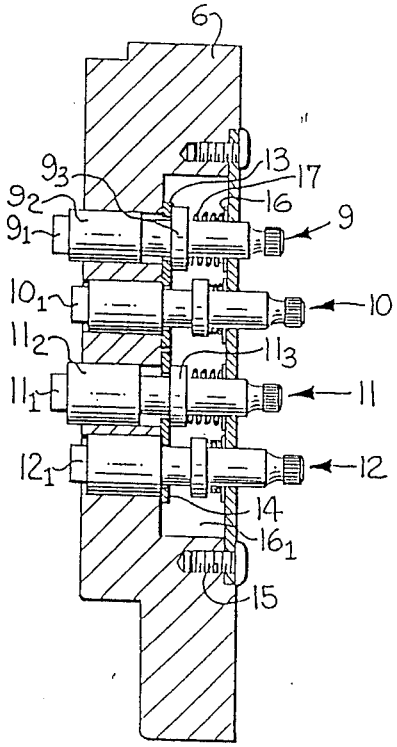
FIG. 2 is a vertical sectional view through the dial, being taken substantially along the line 2—2 in FIG. 1.
Figure 3:
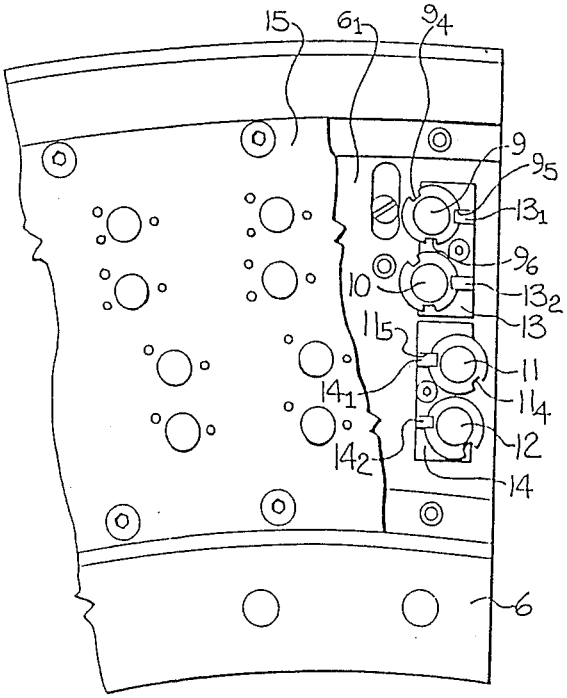
FIG. 3 is a fragmentary plan view of the dial cam holder, showing the opposite side from that shown in FIG. 1.

As shown in FIG. 2, a larger diameter collar $9_3$ extends outwardly beyond the shaft portion $9_2$. This collar $9_3$ is provided with three spaced-apart peripheral notches or slots $9_4$, $9_5$ and $9_6$ (FIG. 3). A locking key $13_1$ extends upwardly from a plate member 13 attached along the bottom of a recess $16_1$ of the dial cam holder 6. Positioning of the knit selector cam cylinders 9, 10 can be accomplished by engagement with one of the three peripherally spaced slots with the respective locking members $13_1$ and $13_2$.

Tuck selector cams $11_1$ and $12_1$ are formed on the inner ends of corresponding tuck selector cam cylinders 11, 12, and are aligned to engage the corresponding tuck selector butts **4*d*, 5*e* on the respective dial needles 4, 5. The knit selector cam cylinder 11 is provided with an enlarged collar $11_3$ (FIG. 2) which is spaced from the cylindrical shaft portion $11_2$ and provided with two peripherally spaced locking notches or slots $11_4$ and $11_5$ (FIG. 3). The positioning of the cylinder 11 is carried out by meshing one of the slots $11_4$ or $11_5$ with a locking key $14_1$ extending upwardly from plate 14. Selective positioning of the cylinder 12 is accomplished in the same manner as the cylinder 11** with meshing of a locking key $14_2$.

As shown in FIG. 2, a compression spring 17 surrounds the cylinder 9 and extends between a washer 16 inside of a cover plate 15 and the enlarged collar $9_3$ so that the cylinder 9, as well as the other cylinders 11–12, are resiliently urged inwardly to the locked position. In order to change the position of any of the cylinders 9–12, the selected cylinder is moved outwardly, as illustrated by the cylinders 10 and 12 in FIG. 2, so that the same can be rotated and positioned in a new locked position.

Figure 4:
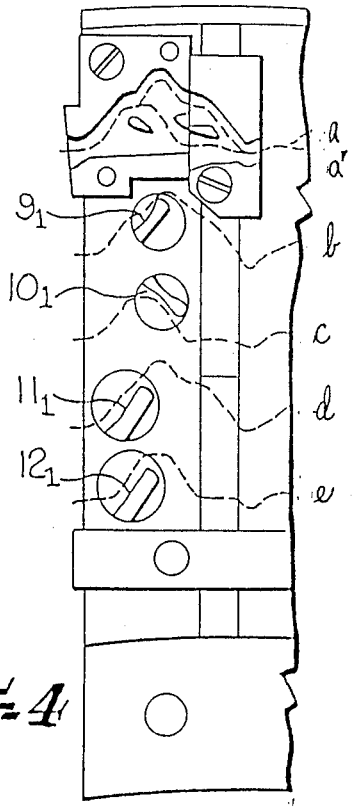
FIG. 4 is a somewhat schematic developed layout view of one feed of the machine and illustrating one of the knit selector cams being positioned to withdraw the dial needles at an earlier than normal position, as when knitting a blister knit type stitch construction.
Figure 6:
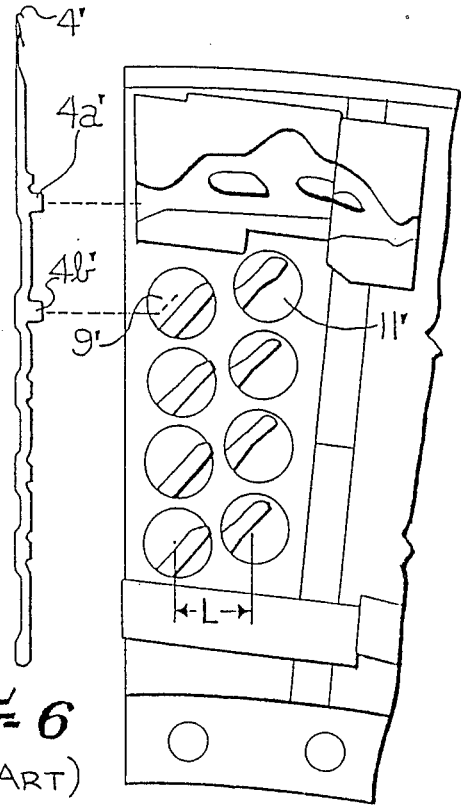
Fig. 6 (PRIOR ART)
FIG. 6 is a developed layout view of the tuck and knit cam selector devices of a conventional prior art type knitting machine.

The four cam track pathways along which the corresponding tuck and knit selector butts of the dial needles 4, 5 pass are shown in dotted lines indicated at **4*b*, 5*c*, 4*d*, and 5*e* (FIGS. 1 and 4). Cam tracks 4*a* and 5*a* ' are followed by the main butts of the dial needles 4, 5 and are formed by the outer guard cam 7 and the stitch cam 8. Cam tracks 4*b* and 5*c* are formed by the knit selector cams $9_1$ and $10_1$. Cam tracks 4*d* and 5*e* are formed by the tuck selector cams $11_1$ and $12_1$. The cam tracks for dial knitting needle 4 and the cam tracks for dial knitting needle 5** are basically the same in that each of these cam tracks permits either type of needle to be selectively positioned in one of three positions, knit, tuck and welt positions, at each of the feeds.

In addition to the heretofore described three positions in which the cam cylinders 9, 10 can be positioned (FIGS. 1–3), the cam cylinders $9_1$, $10_1$ (FIG. 4) can also be positioned in a fourth position so that the dial needles 4, 5 are withdrawn at an earlier than normal position (FIG. 5) to prevent interference with the feeding of yarn to the cylinder needles 40, 50 when stitch loops are being formed only on groups of the cylinder needles, such as when blister knit stitch construction is being knit. In normal double knitting on both the dial needles 4, 5 and cylinder, needles 40, 50 (FIG. 5) the cylinder needles 40, 50 are raised to latch clearing level, pick up a yarn Y in their hooks, and are then lowered to stitch drawing level, along dash-dot line 20. At the same time, the dial needles 4, 5 are moved outwardly to latch clearing level (beyond the location shown in FIG. 5), pick up the yarn Y in their hooks, and then drawn inwardly to form stitch loops on both the dial and cylinder needles.

Figure 5:
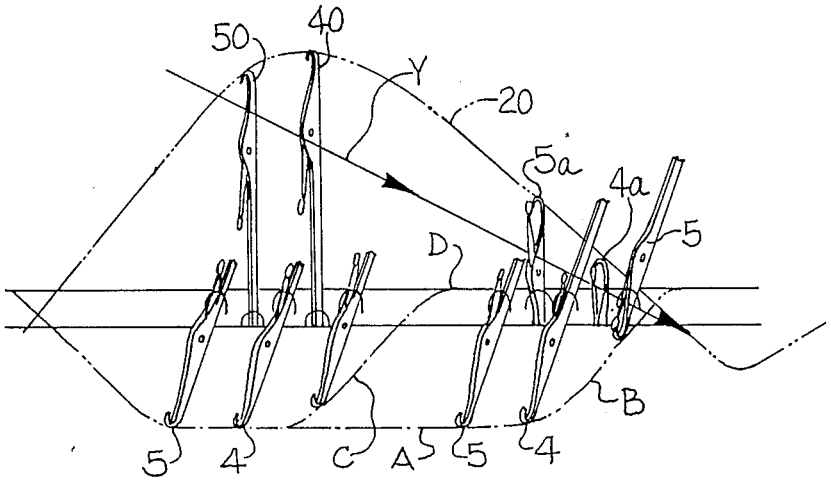
FIG. 5 is a schematic view of the paths of travel of the dial and cylinder needles.

When it is desired to knit on cylinder needles only, the yarn Y (being fed to the cylinder needles 40, 50) will be caught by the hooks of the dial needles 4, 5, if these dial needles 4, 5 are withdrawn in the usual manner, following the dash-dot lines A and B in FIG. 5. To avoid having the yarn Y being fed into the hooks of the dial needles 4, 5, the dial needles are withdrawn at an earlier than normal position, along the dash-dot line C, to an inner welt position, as indicated at D. Thus, the hooks of the dial needles 4, 5 are positioned inwardly of the position at which the yarn Y is fed to and drawn downwardly by the cylinder needles 40, 50 so that the dial needles 4, 5 do not interfere with the feeding of the yarn Y to the cylinder needles 40, 50.

The dial needles 4, 5 are withdrawn early by positioning the cam cylinders 9, 10 in the fourth position, as indicated by the cam $10_1$ in FIG. 4. With the cam $10_1$ in this fourth position, the dial needles move inwardly at an earlier than normal position, as indicated by the dotted pathway **5*c* in FIG. 4. As has been mentioned, the dial needles 4, 5 are moved outwardly between the cylinder needles 40, 50, as shown in the right-hand portion of FIG. 5, to prevent the stitch loops from riding up the cylinder needles 4*a*, 5*a*** as they are raised to latch clearing position.

METHOD OF OPERATION

With the two tuck selector cams $11_1$ and $12_1$ and the two knit selector cams $9_1$ and $10_1$ positioned as shown in FIG. 1, the action of the dial needles 4, 5 will be described as they move from left to right through the three feeds 1–3. At feed 1, the tuck selector butts **4*d* and 5*e* engage the respective tuck selector cams $11_1$ and $12_1$ to move the corresponding dial needles 4, 5 outwardly to tuck position along cam tracks 4*d* and 5*e* so that the main butts 4*a*, 5*a* each move outwardly along guard cam surfaces $7_1$ and $7_2$ and above a guard cam $7_4$. The knit selector butt 5*c* of the needle 5 is not raised by the corresponding knit selector cam $10_1$ so that its main butt 5*a* is not moved outwardly and passes above guard cam $7_5$. The knit selector butt 4*b* of the needle 4 is engaged and moved outwardly by the knit selector cam $9_1$ so that this needle 4 is moved outwardly to a shed position where the stitch loop is positioned inwardly of the tip of the latch thereof. The main butt 4*a* of the needle 4 then engages and is moved inwardly by inclined portion $7_6$ of the guard cam 7 so that it is drawn back inwardly to a position corresponding with the needle 5. The main butts 4*a* and 5*a* of both needles are then moved inwardly by the inwardly inclined portion $8_1$ of the stitch cam 8 and both needles are drawn inwardly to stitch drawing level, above the cam portions $8_2$ and $8_3$ of the stitch cam 8. Thus, at feed 1 the needles 4 knit while the needles 5** tuck, that is, they pick up a yarn in their hooks without knitting the same.

As the needles 4, 5 pass the feed 2, the tuck selector butt **4*d* engages the tuck selector cam $11_1$ to move the needle 4 outwardly to the tuck position. Since the knit selector cam $9_1$ does not engage the butt 4*b* of the needle 4, this needle 4 remains in the tuck position as it passes the feed 2. The tuck selector cam $12_1$ is in the inoperative position so that the tuck selector butt 5*e* of needle 5 is not engaged thereby so that the needle 5 passes the feed 2 in a welt or float position without being projected outwardly by either the tuck selector cams or the knit selector cams. Thus, at feed 2, the needles 4 are moved outwardly to tuck position while the needles 5** remain in a welt or float position.

At the next feeding station 3, the knit selector butt **4*b* and the tuck selector butt 4*d* of the dial needle 4 do not engage the respective knit and tuck selector cams so that these needles do not move outwardly, as indicated by the dotted line in FIG. 1, so that the needles 4 move past the feed 3 in welt or float position. The butt 5*e* of dial needle 5 engages the tuck cam $12_1$ and is moved outwardly thereby. Then, the knit selector butt 5*c* engages the knit selector cam $10_1$ so that the needle 5 is moved outwardly to the knit position. Thus, at feed 3 the needles 4 welt or float while the needles 5 knit. While the present invention has been described and illustrated in the operation of dial needles 4, 5**, it is to be understood that the present selector system could be provided to control cylinder needles in a similar manner.

In comparison with the conventional type of circular knitting machine in which the needles have only one selector butt at four different levels in addition to the master butt and wherein two rows of four rotatable cylindrical selector cams are used for controlling the positioning of the needles by the selector butts, the present invention provides for greatly increasing the number of feeds around the circular knitting machine by using a combination of two types of knitting needles, each having at least two selective or selector butts at different levels, in addition to a master butt. Also, the present invention provides only two knit selector cam cylinders and two tuck selector cam cylinders. The two tuck selector cam cylinders are positioned to overlap portions of the two knit selector cam cylinders to permit the tuck and knit selector cams to be arranged at the closest possible lateral distance from each other. This close positioning of the tuck and knit selector cams thereby permits an increased number of feeds to be positioned around the machine. For example, with the selector cam system of the present invention, the number of feeds has been increased from 48 to 72 in a 30 inch diameter circular knitting machine.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular knitting machine including a multiple number of feeds spaced around the machine, and selector means positioned immediately in advance of each of said feeds and being operable to selectively position dial and cylinder needles in one of four positions, knit, tuck, welt and early withdrawal positions at each of said feeds, the combination therewith of two types of knitting needles, each of said two types of needles including a master butt, a knit selector butt, and a tuck selector butt, stitch cams for engaging said master butt and drawing all of said needles to a stitch forming level immediately following each of said feeds, two tuck selector cams positioned in advance of the position where said needles are drawn to stitch forming level, said tuck selector cams being aligned to engage said tuck selector butts, two knit selector cams aligned to engage said knit selector butts, cylinders mounted for rotation and supporting said tuck and knit selector cams to selectively position the same in operative position, and wherein said knit selector cam cylinders are rotatable to the early withdrawal position to cause dial needles to be moved inwardly at an earlier than normal position to prevent interference with the feeding of yarn to the cylinder needles when forming blister type stitch constructions.

2. A circular knitting machine according to claim 1 wherein said tuck selector cam cylinders are positioned to overlap portions of said knit selector cam cylinders to permit said tuck and knit selector cams to be arranged at the closest possible lateral distance from each other and to thereby permit an increased number of feeds to be positioned around the machine.

* * * * *